US005566554A

United States Patent [19]

Vijayaraghavan et al.

[11] Patent Number: 5,566,554

[45] Date of Patent: Oct. 22, 1996

[54] HYDROCARBON GAS SEPARATION PROCESS

[75] Inventors: Bharat Vijayaraghavan, Houston; Ricardo J. Ostaszewski, Sugarland, both of Tex.

[73] Assignee: KTI Fish, Inc., Houston, Tex.

[21] Appl. No.: 476,835

[22] Filed: Jun. 7, 1995

[51] Int. Cl.[6] ..... F25J 3/00

[52] U.S. Cl. ..... 62/621

[58] Field of Search ..... 62/621

[56] References Cited

U.S. PATENT DOCUMENTS

| | | | |
|---|---|---|---|
| 2,880,592 | 4/1959 | Davidson et al. | 62/621 |
| 3,292,380 | 12/1966 | Bucklin | 62/621 |
| 4,171,964 | 10/1979 | Campbell et al. . | |
| 4,278,457 | 7/1981 | Campbell et al. . | |
| 4,456,461 | 6/1984 | Perez . | |
| 4,507,133 | 3/1985 | Khan et al. | 62/621 |
| 4,519,824 | 5/1985 | Huebel | 62/621 |
| 4,617,039 | 10/1986 | Buck | 62/621 |
| 4,657,571 | 4/1987 | Gazzi . | |
| 4,710,214 | 12/1987 | Sharma et al. | 62/621 |
| 4,846,863 | 7/1989 | Tomlinson et al. . | |
| 4,854,955 | 8/1989 | Campbell et al. . | |
| 4,889,545 | 12/1989 | Campbell et al. . | |

*Primary Examiner*—Ronald C. Capossela

*Attorney, Agent, or Firm*—Seidel, Gonda, Lavorgna & Monaco, P.C.

[57] ABSTRACT

A process for the recovery of components of a feed gas containing methane and heavier components utilizing a demethanizer wherein at least two separation stages are provided, in which at least a portion of the liquid condensate from the first separation is partially vaporized to provide a vapor component that, when directed to a first feed point on the demethanizer, preferably functions as an enhanced reflux stream in the demethanizer. Preferably, the first separation is conducted at a higher pressure than the second separation, and both separations are preferably conducted at pressures higher than the operating pressure of the demethanizer.

16 Claims, 2 Drawing Sheets

HYDROCARBON GAS SEPARATION PROCESS

FIELD OF THE INVENTION

The invention is directed generally to processes for recovering liquids from multicomponent feed gases. In a preferred aspect, this invention is directed to cryogenic processes for separating methane-containing feed gases.

BACKGROUND OF THE INVENTION

Various cryogenic processes have been used in the past to recover ethane and heavier hydrocarbons from multicomponent gas streams such as natural gas, refinery gas and synthetic gas streams, which comprise mostly methane. A typical gas stream might contain about 90 wt % methane; about 5 wt % ethane; ethylene and other $C_2$ components; and about 5 wt % heavier hydrocarbons such as propane, propylene, butanes, pentanes, etc. and non-hydrocarbon components such as nitrogen, carbon dioxide and sulfides. In a cryogenic process for ethane recovery, such a feed gas would be cooled and condensed to form a two-phase that would be separated. The vapor portion would be expanded in a turboexpander to a lower pressure, and one or more of the components would be fractionated in a demethanizer column to recover ethane. Residual gas leaving the demethanizer column would be compressed to feed gas pressure.

Ongoing efforts have been made to improve such processes, for example, by attempting to increase ethane recovery while reducing the external energy consumption. Accordingly, the present invention offers an improved cryogenic process having certain advantages, some of which are discussed specifically below.

SUMMARY OF THE INVENTION

The invention is directed to a process for recovering liquids from gas streams. In a specific aspect, the invention is directed to a cryogenic fractionation or distillation process in which a demethanizer is employed to remove light hydrocarbons such as methane from a feed gas, and to recover the heavier hydrocarbons as liquids. In one aspect of the invention the feed gas is condensed and at least a portion of the liquid condensate is processed as discussed below to provide an enhanced reflux stream or agent for the demethanizer column. More particularly, at least a portion of the feed gas is condensed and separated in a first separation stage under a relatively high pressure to provide a first vapor portion with a first composition and a first liquid condensate portion with a second composition. At least a portion of the first liquid condensate is partially vaporized and separated in a second separation stage to provide a second vapor portion with a third composition and a second liquid portion with a fourth composition. The second vapor portion may be condensed and fed to the demethanizer as a first refluxing agent, which shall be referred to herein as an "enhanced" refluxing agent or stream. The second liquid portion may be expanded to a reduced pressure and fed to the demethanizer.

Advantageously, the various streams may be configured to provide heating and/or cooling, as discussed below. For example, the first liquid condensate may be heated by transferring heat from another stream in heat exchange relation and having a higher temperature, such as the feed gas stream. With such a heating arrangement, together with expansion of the liquid condensate from the first vapor-liquid separation, dual objectives may be achieved, namely, generation of enhanced reflux and providing additional cooling to the feed gas, which may tend to reduce the overall external energy requirements.

In a specific embodiment of the invention, the pressure during the second separation stage is an "intermediate" pressure, lower than the first separation pressure yet higher than the operating pressure of the demethanizer. For example, the feed gas may be cooled sufficiently under a first pressure to provide a first vapor portion and a first liquid portion or condensate. The first liquid portion or condensate may then be partially vaporized at an intermediate pressure to provide a second vapor portion and a second liquid portion. The second vapor and liquid portions may then be fed to the demethanizer, either directly or after additional processing.

In a specific embodiment of the invention, at least two vapor-liquid separators are provided, each being operated at different pressures, both of which are above the operating pressure of the demethanizer. Typically, the first separator is operated at inlet gas pressure, and functions as the "high pressure separator" of the process. The first vapor stream, from the first separator, may be directed to a first selected point on the demethanizer. In a specific embodiment, prior to entering the demethanizer, that vapor stream is expanded to a lower pressure, preferably the operating pressure of the demethanizer, to provide a liquid condensate, which may be a single-phase liquid stream or a two-phase stream. The second separator provides a second vapor stream, which may be directed to a second selected point on the demethanizer. That stream may be referred to as an "enhanced" refluxing agent. Prior to its introduction to the demethanizer, the second vapor stream should be at least partially condensed to form a liquid condensate, and then expanded to a lower pressure, preferably the operating pressure of the demethanizer. Preferably, the second selected point on the demethanizer is above the first selected point. The temperature of the liquid condensate from the second vapor stream may be lower than the temperature of the condensate of the first vapor stream.

In accordance with certain specific embodiments of the invention, under certain conditions, ethane and other $C_2$ component recovery may be improved. Further, an enhanced refluxing agent is provided, and external energy requirements may be lowered. As a further benefit, problems associated with $CO_2$ solidification or freezing may be reduced or avoided. For example, in a specific embodiment of the invention, the process may be operated so that the second liquid portion from the intermediate pressure separator includes a substantial proportion of the $CO_2$ from the feed stream and is fed to a warmer section of the demethanizer, thus avoiding $CO_2$ freezing.

Certain aspects of the invention are discussed below in greater detail including aspects preferred by the inventors and specific examples and embodiments shown in the drawings. The scope of invention, however, is to be determined with reference to the patent claims, including any equivalent processes.

DETAILED DESCRIPTION OF THE INVENTION

Figure 1:
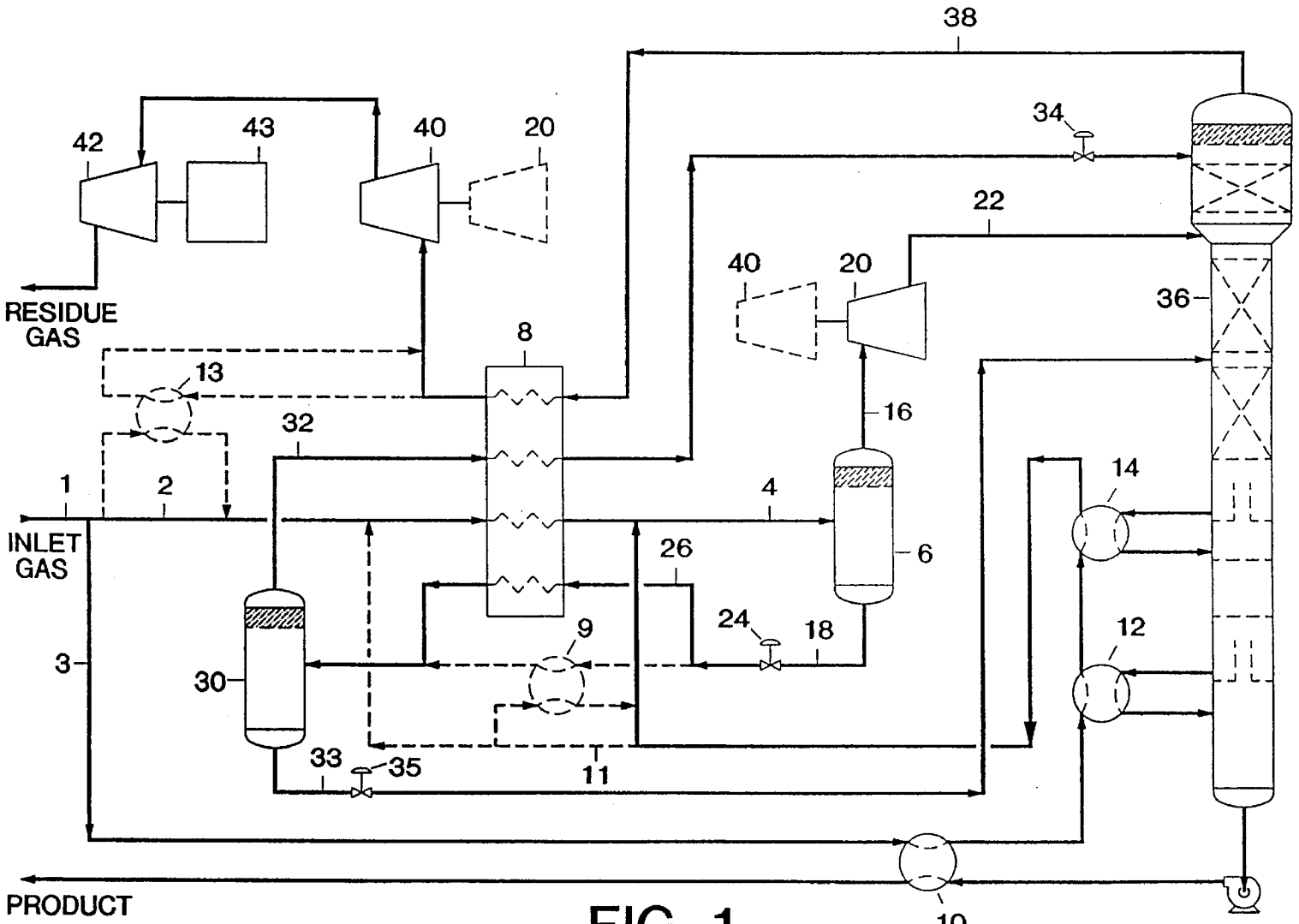
FIG. 1 is a schematic flow diagram, showing a preferred embodiment of the invention, the broken lines indicating several alternative schemes.

In the specific process shown in FIG. 1, feed stream 1 has a temperature of about 90° F. However, temperature may vary depending on the source of the feed gas. For example, a natural gas from a pipeline may have a temperature between about 60° and 125° F. The feed or inlet stream is a multicomponent feed gas that includes light components such as methane, as well as other heavier gaseous components such as ethane, ethylene,, propylene, propane and heavier hydrocarbons. The feed gas may also include non-hydrocarbon components such as carbon dioxide, nitrogen, hydrogen, and sulfides. In a specific aspect of the invention, the feed gas may have a relatively high $CO_2$ concentration, e.g., about 1–2 mol % or more. The feed gas may be natural gas or a processed gas, including refinery or synthesis gas. Prior to cooling, the feed gas may be processed in a conventional manner to remove amounts of impurities, including non-hydrocarbon components such as sulfur and carbon dioxide. Also, prior to cooling, the feed gas may be compressed and dehydrated to minimize hydrate formation during the process.

The feed gas of stream 1 may be split or divided into two streams 2 and 3 both having the same composition as stream 1. As shown in FIG. 1, and as discussed in greater detail below, stream 3 may be processed in a variety of ways to take advantage of the heat transfer capabilities inherently possessed by the feed gas, which typically has a higher temperature than other streams in the process.

In the specific embodiment shown in FIG. 1, stream 2 is cooled in heat exchanger 8 to a lower temperature, which for illustrative purposes may range from about −30° to −85° F., for example, −64° F. Alternatively, this cooling step may be accomplished or supplemented by a chiller, series of chillers, or one or more refrigeration devices, not shown here, and may have various recycle configurations. For example, the broken line in FIG. 1 shows stream 2 being directed through heat exchanger 13 in heat exchange relation with stream 38. However, in a preferred embodiment of the invention, to minimize energy consumption, a single heat exchanger 8 is used to accomplish the heating and cooling of the various streams, particularly the initial cooling of the feed gas stream 2 and the heating of the expanded liquid condensate 26 coming from the high pressure separator. A conventional plate-fin exchanger may be used for this purpose.

As shown in FIG. 1, the various streams, including output streams from the separators, and in particular streams 2, 26, and 38, are preferably positioned in heat exchange relation to provide cooling and heating in the heat exchanger 8. For example, the warmer stream 2 may be cooled by transferring heat to cooler stream 26, which may thereby be heated prior to entering separator 30.

The cooled feed stream 4 is fed to a separator 6, which may be a conventional gas-liquid separation device. The cooling of streams 2 and 3 causes partial condensation, so that stream 4 is a two-phase stream. In separator 6, stream 4 may be separated into a vapor stream 16, which is at least predominantly vapor, and a liquid stream 18, which is at least predominantly liquid. Although the process embodied in FIG. 1 shows that stream 4 is separated immediately after cooling, it will be recognized by persons skilled in the art that additional processing of stream 4 may take place before its introduction to the separator 6, including one or more separations and/or cooling steps. Further, while the cooling step in FIG. 1 is shown as being separate from the separation step, it is contemplated that cooling and separation may be accomplished in a single device. The vapor stream 16 exiting the separator 6 has a first composition, which is typically predominantly methane and which may vary depending on the source of the feed gas and other factors, such as the conditions at which the separator is operated. The liquid stream 18 exiting the separator 6 has a second composition and typically has a higher concentration of heavier components than the feed stream.

The separator 6, which may be referred to herein as the "first separator" or "high pressure separator," operates at a relatively high pressure, preferably the pressure of the inlet feed gas, which may be provided from a pipeline or other source of pressurized gas. For example, the pressure in separator 6 may range from about 450 to 1350 psig, an illustrative pressure being about 835 psig.

As shown in FIG. 1, the vapor stream 16 from the high pressure separator 6 is preferably directed to a demethanizer 36. As used herein, the term "demethanizer" refers broadly to any device that can remove methane from a feed gas, including what is often referred to as a "deethanizer," which is designed to remove both methane and ethane. Thus, while the demethanizer 36 is shown in FIG. 1 as a demethanizing column, it may also include any distillation device or apparatus capable of removing methane from a feed gas by application of heat, including distillation, rectification, and fractionation columns or towers. Where a demethanizing column is used, it may have different numbers of trays or levels, depending on overall design, efficiencies and optimization consideration.

As used herein, the term "directed" refers to the ultimate destination of the stream and includes configurations in which the stream is processed and changed en route to that destination, for example, by changing temperature, pressure, or vapor-liquid composition. Accordingly, stream 16, containing a light fraction of the original feed gas, preferably passes through an expander 20 where the pressure and temperature are reduced. The term "expander" as used herein includes any appropriate expansion device, such as an expansion valve, or any other work expansion machine or engine that is capable of lowering the pressure of a hydrocarbon stream.

The expander 20 reduces the pressure of the vapor stream to, for example, the operating pressure of the demethanizer 36, which preferably ranges from about 160 to 490 psig. Additionally, the temperature may be reduced to a range of from about −70° to −180° F., for example, to about −135° F., which in a specific embodiment is the temperature at which it enters the demethanizer 36. The stream 22 from expander 20 preferably then flows into the demethanizer column 36 at some midway point, defined herein as a point on the demethanizer lower than the point at which the vapor portion from the second separator 30 enters the demethanizer 36 (discussed below).

Condensed liquid stream 18 exits separator 6. Although not shown, it may be desirable under certain circumstances to divert a portion of the liquid stream 18 to some other part of the process or system. However, at least a portion of the liquid stream from the high pressure separator 6 should be reduced in pressure in controlled expansion valve 24, preferably to a pressure of the intermediate separator 30. Accordingly, a partial vaporization of the liquid stream 18 may be accomplished to provide a two-phase stream 26. The stream 26 from the controlled expansion valve 24 may be heated, for example, in heat exchanger 8, to further vaporize light hydrocarbon components in the liquid portion of stream 26. The broken lines in FIG. 1 show alternative embodiments including one in which the expanded stream 26 is positioned in heat exchange relation with stream 11 in exchanger 9.

Figure 2:
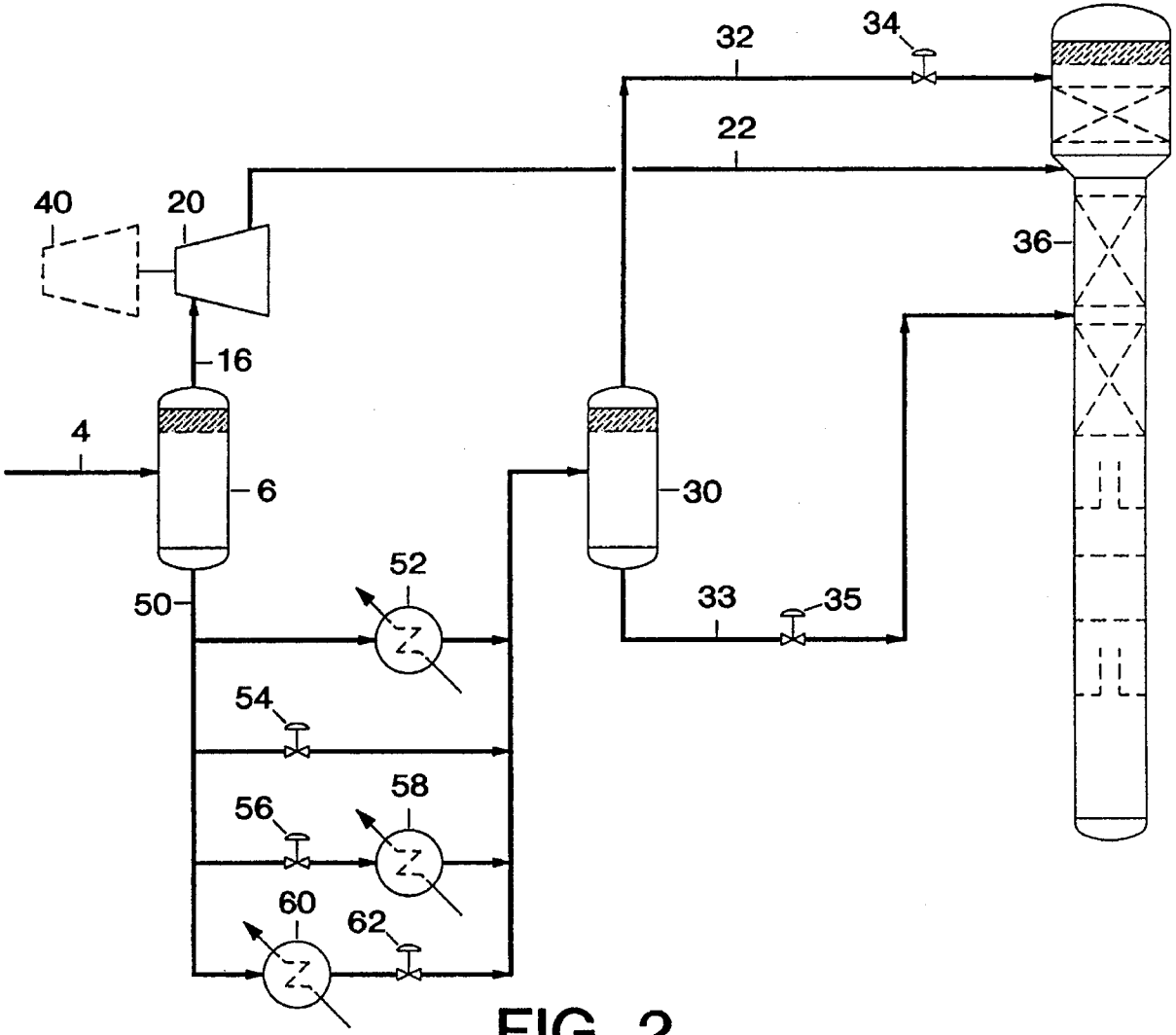
FIG. 2 is a schematic flow diagram showing specific aspects of the invention including partial vaporization of liquid condensate from the first separator and the directing of the vapor components from each separator to provide refluxing agents for the demethanizer.

The invention contemplates a variety of configurations to provide partial vaporization of at least a portion of the liquid condensate stream discharged from the separator 6. As shown in FIG. 2, which uses corresponding reference numbers, there are at least four alternative configurations by which the liquid condensate from separator 6 may be partially vaporized. Referring to FIG. 2, the portion 50 of the liquid condensate that is to be partially vaporized (which corresponds to stream 18 in FIG. 1) may be heated and thus partially vaporized in heat exchanger 52. In another embodiment, stream 50 is partially vaporized by expansion in an expansion valve 54. In still another embodiment, stream 50 is first passed through expansion valve 56, which provides partial vaporization, then heated in exchanger 58 to provide additional vaporization. As an alternative embodiment, stream 50 is first heated in exchanger 60 to provide partial vaporization followed by additional vaporization in expansion valve 62.

Preferably, as illustrated in FIG. 1, stream 26 is placed in heat exchange relation with warmer feed stream 2 in heat exchanger 8. The temperature of stream 26 is preferably elevated about 20° to 50° F. so that, for example, the temperature in the intermediate pressure separator 30 is about −40° F. Although for efficiency the heating of stream 26 may be accomplished in heat exchanger 8, other heating devices may also be used instead of or in addition to heat exchanger 8, including, for example, heat exchanger 9. Advantageously, in accordance with this invention, the lighter components of the condensate from the high pressure separator 6 may thus be separated from the heavier components in an intermediate pressure separator 30 prior to introduction to the demethanizer 36. As discussed below, this aspect may provide for both an enhanced reflux stream and more precise fractionation, particularly in an ethane recovery process, in separating methane from $C_2$ components.

The two-phase stream 26 passes into the vapor-liquid separation device or separator 30, referred to herein as the "medium" or "intermediate" or "second" pressure separator, which is preferably operated at a lower pressure than the high pressure separator 6. A desirable feature of this invention is use of an intermediate pressure separator 30 in conjunction with a high pressure separator 6. Preferably, the intermediate pressure separator 30 is operated at a pressure ranging broadly between the pressure in the high pressure separator 6 and the operating pressure of the demethanizer 36. For example, while the pressure in separator 6 may be about 835 psig, the pressure in separator 30 may be about 500 psig and the pressure of demethanizer 36 about 300 psig. An illustrative pressure range for the intermediate pressure separator 30 is between about 160 and 1350 psig, and more preferably between about 300 and 700 psig. The precise pressure selected for the intermediate pressure separator 30 and the temperature to which stream 26 is heated will depend on overall design considerations, and may be determined by persons skilled in the design and/or operation of cryogenic processes.

After separation, the vapor stream 32 from separator 30 is directed to the demethanizer 36, and is preferably condensed, either totally or partially. Such condensation may be accomplished by passing the stream 32 through any conventional condensation device, to condense most of the vapor before passing it through the controlled expansion valve 34, where the pressure of that stream is reduced to, preferably, the operating pressure of the demethanizer 36. Stream 32 may also be reduced in temperature, preferably by passing it through heat exchanger 8. In a specific embodiment, that temperature may be about −152° F. Preferably, that temperature is lower than the temperature of the stream 22 being introduced to the demethanizer 36. Stream 32 may then be fed to the demethanizer 36, preferably as a top feed relative to stream 22.

Vapor stream 32 has a third composition that is different from the first and second compositions mentioned earlier. In a preferred aspect of the invention, vapor stream 32 is used as an enhanced refluxing agent, having a relatively high methane concentration. The liquid condensate 18 discharged from the high pressure separator 6 typically includes dissolved methane. The partial vaporization of that liquid condensate as discussed above, by heating and/or expansion, results in a two-phase stream 26 that includes a vapor component having a high concentration of the methane that was formerly dissolved in the condensate 18. Upon separation in separator 30 that vapor component preferably becomes stream 32, which has not only a high methane concentration but also a lower concentration of heavier hydrocarbons, which form part of the liquid component of the two-phase stream 26. A high methane concentration and low concentration of heavier hydrocarbons are excellent characteristics for a refluxing agent.

In accordance with a preferred embodiment of this invention, the stream 32 is cooled in heat exchanger 8 and expanded in expansion valve 34 to reduce the pressure, thus forming a condensate with a high methane concentration. When introduced to the demethanizer, the condensed stream functions as an enhanced refluxing agent. The stream 32 should be introduced to the demethanizer at a point above the point at which the condensed vapor portion 22 from the first separator 6 is introduced. Advantageously, the liquid methane from the enhanced reflux stream 32 flows downward in the demethanizer 36, contacting the vapors rising in the demethanizer, which include vaporized heavier hydrocarbons from stream 22. In a specific embodiment, the methane concentration of stream 32 is higher than the methane concentration of stream 22. In an ethane recovery process of the invention, the enhanced reflux stream 32 should increase overall recovery of ethane, by preventing vaporization of at least some ethane from stream 22, which might otherwise be vaporized in the demethanizer and lost as residual gas.

A stream 33 from the second separator 30 may also be directed to the demethanizer 36. In a specific embodiment, stream 33 is expanded in an expansion valve 35 to provide a two-phase stream, which may then be directed to an appropriate feed location in the demethanizer 36. For example, in a specific embodiment, the temperature may be reduced in the expansion valve 35 from about −40° F., the temperature in the medium pressure separator 30, to about −60° F.

Sometimes, when processing a feed gas with a high $CO_2$ concentration, there is a tendency for the $CO_2$ to freeze in the cooler top sections of a demethanizer. Accordingly, in a specific embodiment of the invention, a substantial proportion of the $CO_2$ in the feed gas entering the high pressure separator 6, preferably at least about 50 wt % and more preferably at least about 75 wt %, is dissolved in the liquid portion 18 leaving the high pressure separator 6.

Preferably, a substantial amount of that $CO_2$ is also dissolved in the liquid portion 33 from the intermediate separator 30. That liquid portion 33, after additional processing, is preferably supplied as a mid-column feed to the demethanizer 36 at a point where the temperature is at high enough to avoid freezing, for example, at about −80° F. or higher.

Residue gas stream 38 from the top of the demethanizer column 36 may be used to provide cooling in the heat exchanger 8. Also, the stream 38 exiting from heat exchanger 8 may be partly compressed in a booster compressor 40, which is driven by a turboexpander 20. A compression stage 42 may also be provided, which may be driven by a supplemental power source 43 to recompress the residue gas to desired levels, for example, to meet pipeline pressure requirements.

Stream 3 may be directed in a variety of ways and configurations to transfer heat effectively among the various streams. For example, stream 3 may be directed to heat exchange relation with streams from the demethanizer, shown circulating through heat exchangers 10, 12 and 14. By exchanging heat with those streams, which are thereby heated and partially vaporized, stream 3 is thereby cooled and may be combined with stream 4, which has been cooled in heat exchanger 8. Alternatively, as shown by broken lines, stream 11 may be directed through heat exchanger 9 in heat exchange relation between a stream 26, which is a partially vaporized portion of the liquid condensate 18 from separator 6. As a consequence of passing through heat exchanger 9, the condensate 18 from separator 6 is heated while stream 11 is cooled. Other 10 alternative configurations, while not discussed herein, are shown by broken lines in FIG. 1. By configuring the streams in this or other manners, the overall external energy requirements of the process may be lowered.

A person skilled in the art, particularly one having the benefit of the teachings of this patent, will recognize many modifications and variations to the specific processes disclosed above. For example, a variety of temperatures and pressures may be used in accordance with the invention, depending on the overall design of the system and the composition of the feed gas. Also, the feed gas cooling train represented schematically by heat exchangers 8, 10, 12 and 14 may be supplemented or reconfigured depending on the overall design requirements to achieve optimum and efficient heat exchange requirements. For example, more than one heat exchanger may be used, and additional chillers and other refrigeration devices may likewise be used. Also, vapor-liquid separators may be used in addition to the two separators exemplified in the drawing, and fractionating devices may be used as separators. Additionally, certain process steps may be accomplished by adding devices that are interchangeable with the devices shown. For example, separating and cooling may be accomplished in a single device. As discussed above, the specifically disclosed embodiments and examples should not be used to limit or restrict the scope of the invention, which is to be determined by the claims below and their equivalents.

We claim:

1. A process for separating components of a feed gas containing methane and heavier hydrocarbons, comprising the steps of:

condensing said feed gas to provide a first vapor component comprising vapor and a first liquid component comprising condensed liquid;

directing said first vapor component to a demethanizer; and partially vaporizing at least a portion of said first liquid component to form a second vapor component and a second liquid component, said second vapor and liquid components being directed to different feed points on the demethanizer.

2. The process of claim 1 further comprising the steps of directing the second vapor component to the demethanizer in which, prior to being fed to the demethanizer, the second vapor component is partially or totally condensed to form a reflux agent, the pressure of said reflux agent being lowered by expansion and fed to the demethanizer.

3. The process of claim 2 in which said first liquid component is formed by steps that include cooling and separating the feed gas in one or more heat exchangers and in one or more separation stages.

4. The process of claim 1 in which the first and second vapor components have different compositions.

5. The process of claim 4 in which the first and second vapor components are partially condensed prior to introduction to the demethanizer.

6. The process of claim 1 in which the step of partially vaporizing the first liquid component includes the step of lowering the pressure of said first liquid component by :expansion to provide an expanded first liquid component or heating said first liquid component or both, wherein the expansion step may either precede or follow the heating step.

7. The process of claim 1 in which the step of directing the second liquid component to the demethanizer includes expanding the second liquid component prior to being fed to the demethanizer.

8. The process of claim 1 in which the pressure of said first liquid component is higher than the pressure at which at least a portion of the first liquid component is partially vaporized to form the second vapor component and second liquid component.

9. The process of claim 1 in which the first vapor component is directed to a first point on the demethanizer and the second vapor component is directed to a second point on the demethanizer, said second point being higher than said first point.

10. The process of claim 1 in which said first vapor component is expanded to a lower pressure and ted into the demethanizer column at a first feed point.

11. The process of claim 1 additionally comprising the step of totally or partially condensing the first vapor component and feeding the resulting condensate to the demethanizer.

12. The process of claim 1 further comprising:

totally or partially condensing the first vapor component and feeding the resulting condensate to the demethanizer; and totally or partially condensing the second vapor component and feeding the resulting condensate as a refluxing agent to the demethanizer.

13. The process of claim 1 further comprising:

totally or partially condensing the first vapor component and feeding the resulting condensate to the demethanizer; and totally or partially condensing the second vapor component and feeding the resulting condensate to the demethanizer as a refluxing agent, wherein the refluxing agent is fed to the demethanizer at a higher point than the point at which the condensate from the first vapor component is fed.

14. A process for recovering components of a feed gas containing methane and heavier hydrocarbons comprising:

cooling said feed gas under a first pressure to provide a first vapor portion and a first liquid portion;

partially vaporizing at least a portion of said first liquid portion at a second pressure to provide a second vapor portion and a second liquid portion; and directing said second vapor and liquid portions to the demethanizer, wherein said second pressure is lower than said first pressure.

15. A process for the recovery of components of a feed gas under high pressure containing methane and heavier components comprising:

cooling said feed gas under high pressure to form a liquid portion under said high pressure and a vapor portion under said high pressure;

directing said vapor portion under said high pressure through an expander such that the vapor portion partially condenses into a second liquid portion;

feeding said second liquid portion into said demethanizer column at a first feed point;

expanding at least part of said liquid portion under said high pressure to an intermediate pressure that is lower than said high pressure but higher than said low pressure, resulting in a flashed liquid portion;

passing said flashed liquid portion through a heat exchanger to vaporize at least part of said flashed liquid portion to produce a partially vaporized stream;

dividing said partially vaporized stream into at least two streams, wherein the first of said two streams comprises primarily vapors and the second of said two streams comprises primarily liquids; and passing said first stream through a heat exchanger and expanding said first stream to said low pressure and then supplying said first stream as an enhanced reflux stream to said demethanizer column at a second feed point, said second feed point being above said first feed point, and expanding said second stream to said low pressure and supplying said second stream to said demethanizer at a third feed point.

16. The process of claim 15 in which said flashed liquid portion is placed in heat exchange relation with said feed gas or enhanced reflux stream to cool at least part of said feed gas or at least part of said reflux stream or a combination thereof.

* * * * *